US007692370B2

(12) United States Patent
Murata et al.

(10) Patent No.: US 7,692,370 B2
(45) Date of Patent: Apr. 6, 2010

(54) IMAGE DISPLAY APPARATUS

(75) Inventors: Hirotaka Murata, Fukaya (JP); Nobuo Kawamura, Fukaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 388 days.

(21) Appl. No.: 11/768,248

(22) Filed: Jun. 26, 2007

(65) Prior Publication Data

US 2008/0122339 A1 May 29, 2008

Related U.S. Application Data

(63) Continuation of application No. PCT/JP2005/023067, filed on Dec. 15, 2005.

(30) Foreign Application Priority Data

Dec. 27, 2004 (JP) ..... 2004-377472

(51) Int. Cl.
*H01J 1/62* (2006.01)

(52) U.S. Cl. ..... 313/495; 313/496; 313/497

(58) Field of Classification Search ..... 313/495–496
See application file for complete search history.

(56) References Cited

U.S. PATENT DOCUMENTS

| | | | | |
|---|---|---|---|---|
| 6,512,329 | B1 * | 1/2003 | Mitsutake et al. | 313/495 |
| 2004/0195958 | A1 * | 10/2004 | Ito et al. | 313/496 |
| 2004/0227453 | A1 | 11/2004 | Ando et al. | |

FOREIGN PATENT DOCUMENTS

| | | | |
|---|---|---|---|
| JP | 10-188863 | A | 7/1998 |
| JP | 10-302684 | A | 11/1998 |
| JP | 10-326583 | | 12/1998 |
| JP | 2000-251797 | | 9/2000 |
| JP | 2001-243893 | | 9/2001 |
| JP | 2003-68237 | | 3/2003 |
| JP | 2004-158232 | | 6/2004 |
| JP | 2004-335346 | | 11/2004 |
| JP | 2004-363094 | A | 12/2004 |
| JP | 2005-123066 | A | 5/2005 |

* cited by examiner

*Primary Examiner*—Nimeshkumar D. Patel
*Assistant Examiner*—Anthony T Perry
(74) *Attorney, Agent, or Firm*—Fitzpatrick, Cella, Harper & Scinto

(57) ABSTRACT

A front substrate includes a phosphor screen including a plurality of phosphor layers arranged at a specific pitch in a first direction and at another specific pitch in a second direction intersecting at right angles to the first direction and including a light-shielding layer, divided metal-back layers laid on the phosphor screen and divided, in the first and second directions, divided getter films laid on the metal-back layer and divided, in the first and second directions, and a thin-film dividing layer formed on divided portions of at least one of the divided metal-back layers and the divided getter-films. Spacers are provided between the front substrate and a rear substrate and oppose to the thin-film dividing layer. Spacer-abutting layers are discretely arranged near the thin-film-dividing layer, at positions where the spacer-abutting layers abut the spacers.

6 Claims, 4 Drawing Sheets

IMAGE DISPLAY APPARATUS

CROSS-REFERENCE TO RELATED APPLICATIONS

This is a Continuation Application of PCT Application No. PCT/JP2005/023067, filed Dec. 15, 2005, which was published under PCT Article 21(2) in Japanese.

This application is based upon and claims the benefit of priority from prior Japanese Patent Application No. 2004-377472, filed Dec. 27, 2004, the entire contents of which are incorporated herein by reference.

BACKGROUND OF THE INVENTION

1. Field of the Invention

The present invention relates to an image display apparatus, and more particularly to a planer image display apparatus that uses electron-emitting elements.

2. Description of the Related Art

In recent years, planer image displays have been developed as next-generation, in which a number of electron-emitting elements are arranged and opposed to the phosphor screen. Various types of electron-emitting elements are available. Basically, they perform electric-field emission. Any display using electron-emitting elements is generally called a field-emission display (hereinafter referred to an FED). Of the various FEDs available, a display that uses surface-conduction electron-emitting elements is called a surface-conduction electron emission display (hereinafter referred to as an SED). Nonetheless, the SED will be referred to as FED in the present application.

An FED has a front substrate and a rear substrate, which are opposed to each other and spaced apart by a narrow gap of about 1 to 2 mm. These substrates fused at their peripheral edges, with a rectangular frame-shaped side wall interposed between them. The substrates therefore form a vacuum envelope. The interior of the vacuum envelope is maintained at high vacuum of about $10^{-4}$ Pa. A plurality of spacers are provided between the substrates, supporting the substrates against the atmospheric pressure applied to them.

On the inner surface of the front substrate, a phosphor screen including red, blue and green phosphor layers is formed. On the inner surface of the rear substrate, a number of electron-emitting elements are provided. These elements emit electrons, which excite the phosphors and make them emit light. On the rear substrate, a number of scanning lines and a number of signal lines are provided, in the form of a matrix. These lines are connected to the electron-emitting elements. An anode voltage is applied to the phosphor screen, accelerating the electron beams emitted from the electron-emitting elements. The electrons thus accelerated impinge on the phosphor screen. The screen therefore emits light, whereby the FED displays an image.

In the FED described above, phosphor of the same type as used in the ordinary cathode ray tube is used in order to provide practical display characteristics. Further, the phosphor screen must have an aluminum film called metal back, which covers the phosphor. In this case, the anode voltage applied to the phosphor screen should preferably be at least several kilovolts (kV), or 10 kV or more if possible.

However, the gap between the front substrate and the rear substrate cannot be made so large, in view of the desired resolution and the characteristic of the spacers. The gap is therefore set to about 1 to 2 mm. Hence, an intense electric field is inevitably applied in the gap between the front substrate and the rear substrate in the FED. Consequently, discharge, if any, between these substrates become a problem.

If no measures are taken against possible damage due to the discharge, the discharge will break or degrade the electron-emitting elements, the phosphor screen, the driver IC and the drive circuit. Possible damage to these components will be generally called discharge damage. In any condition where discharge damage may occur, discharge should be avoided, by all means, for a long time in order to make the FED a practical apparatus. This is, however, very difficult to achieve in practice.

It is therefore important to reduce the discharge current to such a level as would not cause discharge damage or cause but negligibly small discharge damage, even if a discharge takes place. Known as a technique of reducing the discharge current is dividing the metal back into segments. Depending on its configuration, the FED may have a getter layer on the metal back in order to maintain a desired degree of vacuum. In this case, the getter needs to be divided into segments, too. For convenience, terms "metal back dividing" and "divided metal back" will be used hereinafter.

Metal back dividing can be divided mainly to two types. One is one-dimensional dividing, i.e., dividing the metal back, in one direction, into strip-shaped segments. The other is two-dimensional dividing, i.e., dividing the metal back, in two directions, into island-shaped segments. The two-dimensional dividing can more reduce the discharge current than the one-dimensional dividing. Jpn. Pat. Appln. KOKAI Publication No. 10-326583 (hereinafter referred to as Patent Document 1), for example, discloses the basic concept of one-dimensional dividing. Jpn. Pat. Appln. KOKAI Publication No. 2001-243893 (hereinafter referred to as Patent Document 2) and Jpn. Pat. Appln. KOKAI Publication No. 2004-158232 (hereinafter referred to as Patent Document 3) disclose two-dimensional dividing.

If the metal back is divided into segments, it will be necessary to lower provide a path for the beam current, to reduce the luminance decrease to a tolerable level and to prevent discharge due to the potential difference at the gap. In connection with this point, Patent Document 1 and Patent Document 3 disclose a configuration in which a resistance layer is provided between the metal-back segments. Patent Document 2 discloses a configuration in which the metal-back segments are connected to power lines by resistance layers. The technique of providing resistance layers between the metal-back segments is disclosed in Jpn. Pat. Appln. KOKAI Publication No. 2000-251797, too.

To maintain a sufficient degree of vacuum in the envelope of the FED of the configuration described above, a getter film may be provided on the metal back in some cases. In the two-dimensional dividing, too, a getter film may be divided into segments by using projections and depressions made on and in the surface, as is disclosed in, for example, Jpn. Pat. Appln. KOKAI Publication No. 2003-068237 and Jpn. Pat. Appln. KOKAI Publication No. 2004-335346.

In view of the nature of the metal-back segments, i.e., thin films, formed by dividing the metal back, however, the spacers should not abut them. It is therefore necessary to provide a film on that part of each metal-back segment which may contact a spacer, said film being sufficiently flat and strong enough not to be broken or exfoliated in spite of the pressure applied from the spacer.

If a metal back subjected to one-dimensional dividing is used, a dividing film can be dispensed with. In this case, each metal-back segment needs only to have such a width that it is locally connected to two lines. Hence, the discharge current increases but a little.

In a metal back subjected to two-dimensional dividing, however, that part on which spacers are arranged in a line must be subjected to one-dimensional dividing, if the method described above is employed. In this case, the current greatly increases in the vicinity of the spacer line. This restricts the discharge current, much impairing the effect of the two-dimensional dividing. It has therefore been demanded that a technique be developed, which can preserve the characteristic of the two-dimensional dividing even at the spacer line so that the current may not increase.

BRIEF SUMMARY OF THE INVENTION

The present invention has been made to solve the problem described above. An object of the invention is to provide an image display apparatus in which the characteristic of two-dimensional dividing can be preserved even at the spacer line and the discharge current can therefore be reduced, and which can therefore achieve high display performance.

An image display apparatus according to an aspect of the invention, comprises: a front substrate which has a phosphor screen including a plurality of phosphor layers arranged at a specific pitch in a first direction and at another specific pitch in a second direction intersecting at right angles to the first direction and including a light-shielding layer, divided metal-back layers laid on the phosphor screen and divided, in the first and second directions, divided getter films laid on the metal-back layer and divided, in the first and second directions, and a thin-film dividing layer formed on divided portions of at least one of the divided metal-back layers and the divided getter-films; a rear substrate which is opposed to the front substrate and on which are arranged a plurality of electron-emitting elements configured to emit electrons toward the phosphor screen; a plurality of spacers which support the front substrate and the rear substrate against the atmospheric pressure applied to the substrates; and spacer-abutting layers discretely arranged near the thin-film-dividing layer, at positions where the spacer-abutting layers abut the spacers.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

FEDs according to embodiments of this invention will be descried, with reference to the accompanying drawings.

Figure 1:
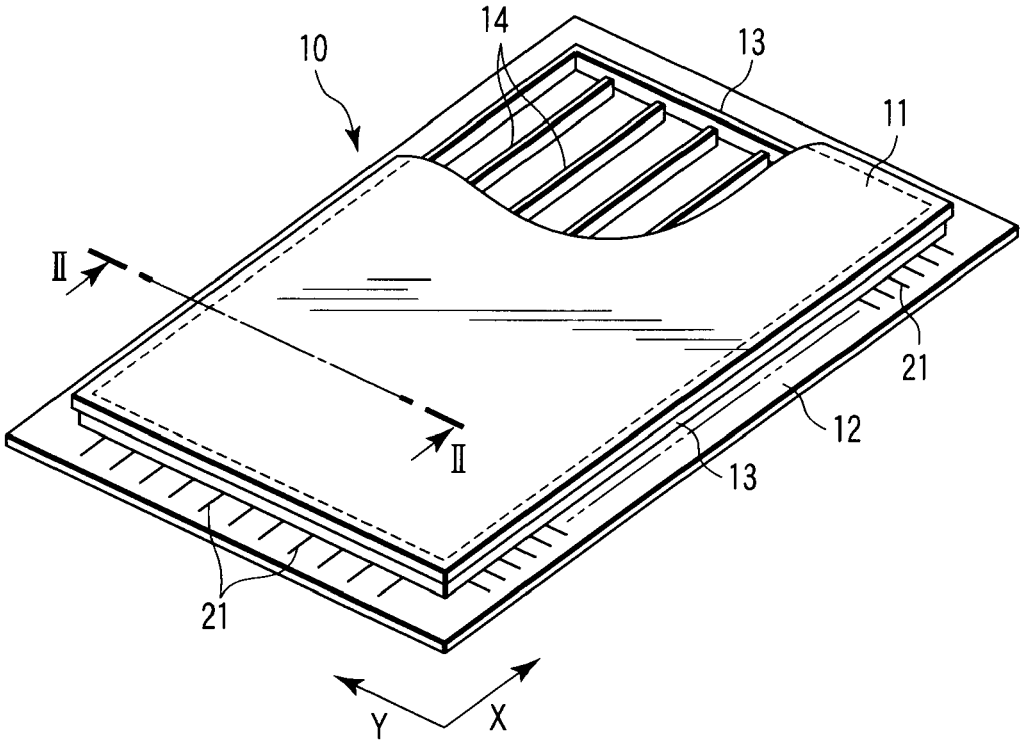
FIG. 1 is a perspective view showing an FED according to a first embodiment of the present invention.
Figure 2:
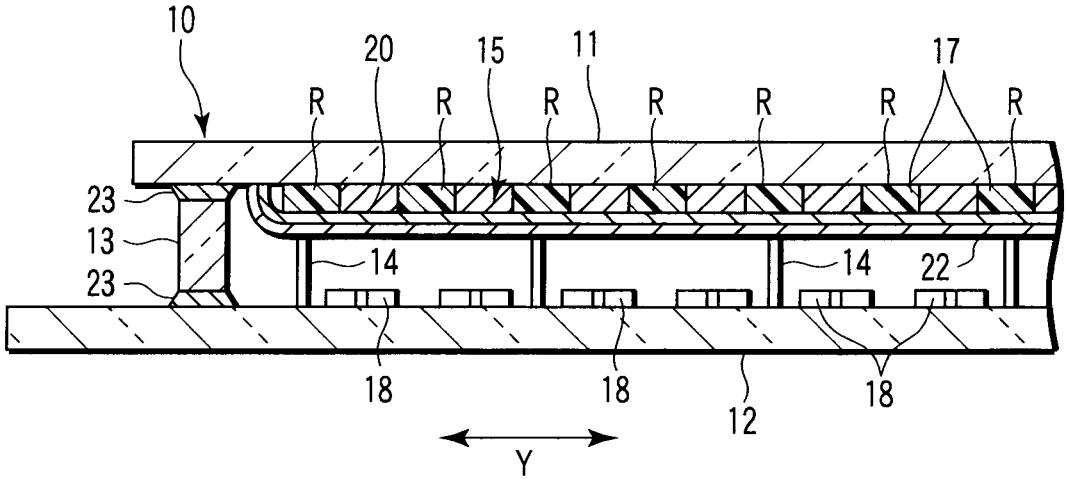
FIG. 2 is a sectional view of the FED, taken along lie II-II shown in FIG. 1.

As shown in FIGS. 1 and 2, an FED according to an embodiment comprises a front substrate 11 and a rear substrate 12. These substrates are opposed, spaced part from each other by a gap of 1 to 2 mm. The front substrate 11 and the rear substrate 12 are coupled together, at their peripheral edges, with a rectangular frame-shaped side wall 13 interposed between them. The substrates therefore form a flat, rectangular vacuum envelope 10, the interior of which is maintained at high vacuum of about $10^{-4}$ Pa. The side wall 13 is sealed to the peripheral edges of the front substrate 11 and those of the rear substrate 12, by a sealing member 23 made of, for example, low-melting glass, low-melting metal, or the like. The side wall 13 therefore connects the substrates to each other.

A phosphor screen 15 is formed on the inner surface of the front substrate 11. The phosphor screen 15 has phosphor layers R, G and B and a matrix-shaped light-shielding layer 17. The phosphor layers can emit red light, green light and blue light. On the phosphor screen 15, a metal-back layer 20 is formed. The metal-back layer 20 is made mainly of aluminum and functions as anode electrode. A getter film 22 is laid on the metal-back layer 20. A predetermined anode voltage is applied to the metal-back layer 20 so that the FED may display images. The structure of the phosphor screen will be described later in detail.

On the inner surface of the rear substrate 12, electron-emitting elements 18 of surface-conduction type are provided. The elements 18 are sources of electrons and emit electron beams, which excite the phosphor layers R, G and B of the phosphor screen 15. The electron-emitting elements 18 are arranged in row and columns such that each may correspond to one pixel. Each electron-emitting element 18 comprises an electron-emitting part and a pair of element electrodes. The element electrodes apply a voltage to the electron-emitting part. A number of lines 21 for driving the electron-emitting elements 18 are provided on the inner surface of the rear substrate 12, forming a matrix. Each line 21 has its ends extending outside the vacuum envelope 10.

A number of long, plate-shaped spacers 14 are arranged between the front substrate 11 and the rear substrate 12, supporting the substrates 11 and 12 against the atmospheric pressure applied to them. The spacers 14 extend in a first direction X and are arranged in a second direction Y, spaced apart from one another at predetermined intervals. Note that the first direction X is the lengthwise direction of the front substrate 11 and rear substrate 12 and the second direction Y is at right angles to the first direction X.

To make the FED to display an image, the anode voltage is applied to the phosphor layers R, G and B through the metal-back layer 20. The anode voltage accelerates the electron beams emitted from the electron-emitting elements 18. Thus accelerated, the electron beams impinge on target phosphor layers R, G and B. The target phosphor layers R, G and B are thereby excited and emit light. As a result, the FED displays an image.

Figure 3:
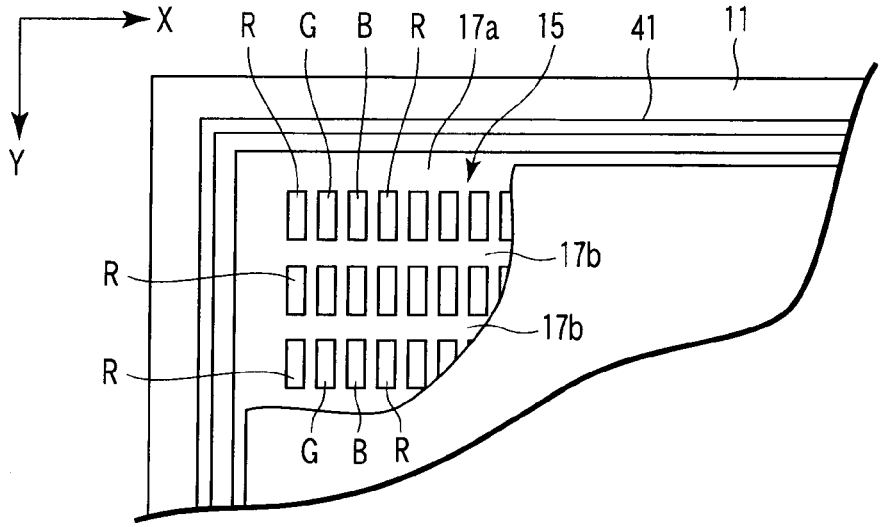
FIG. 3 is a plan view of the phosphor screen on the front substrate of the FED.

The configuration of the front substrate 11 will be described in detail. As FIG. 3 shows, the phosphor screen 15 has many strip-shaped phosphor layers R, G and B that can emit red light, green light and blue light. Then, the phosphor layers R, G and B are repeatedly arrange in the first direction X and spaced at preset intervals, and phosphor layers of the same color are arranged in the second direction Y and spaced at preset intervals. The phosphor layers R, G and B have been formed by a known method, such as screen printing or photolithography. The light-shielding layer 17 has a rectangular frame part 17*a* and a matrix part 17*b*. The frame part 17*a* extends along the peripheral edges of the front substrate 11. The matrix part 17*b* lies in the spaces between the phosphor layers R, G and B.

The pixels (each formed of three phosphor layers R, G and B) are shaped like a square and arranged at pitch of, for example, 600 μm, which will be used as reference dimensional value in specifying the sizes of the other components of the FED.

Figure 4:
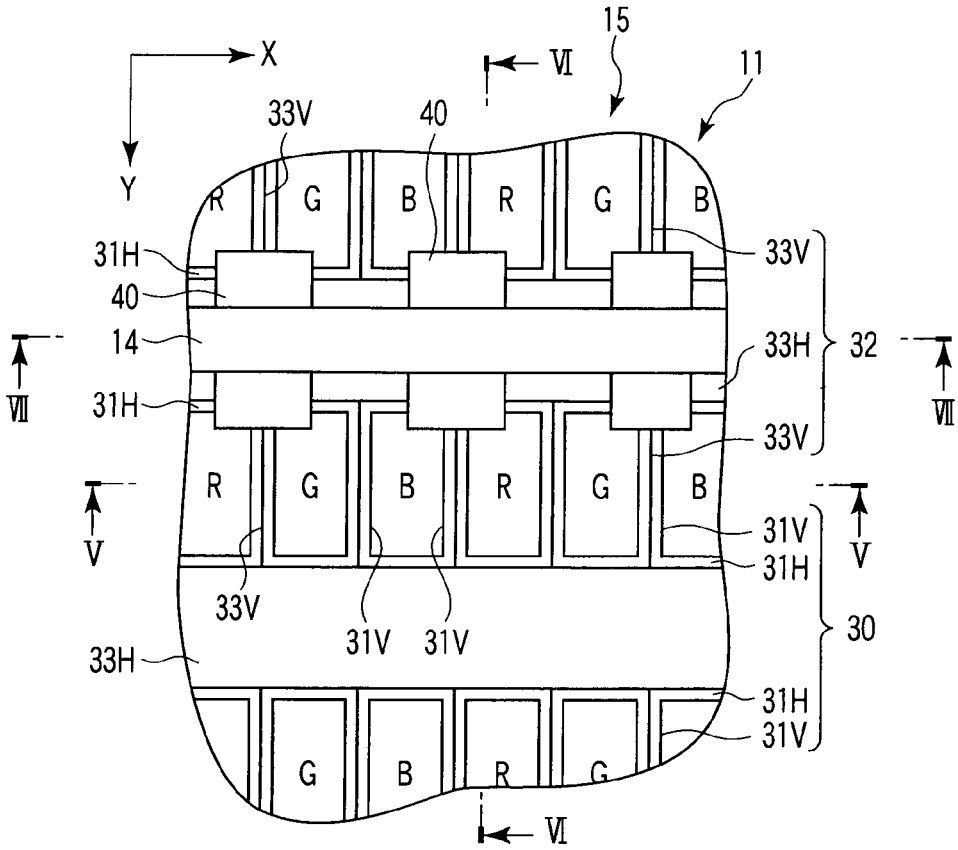
FIG. 4 is an enlarged plan view showing the phosphor screen and resistance-adjusting layer of the FED.
Figure 5:
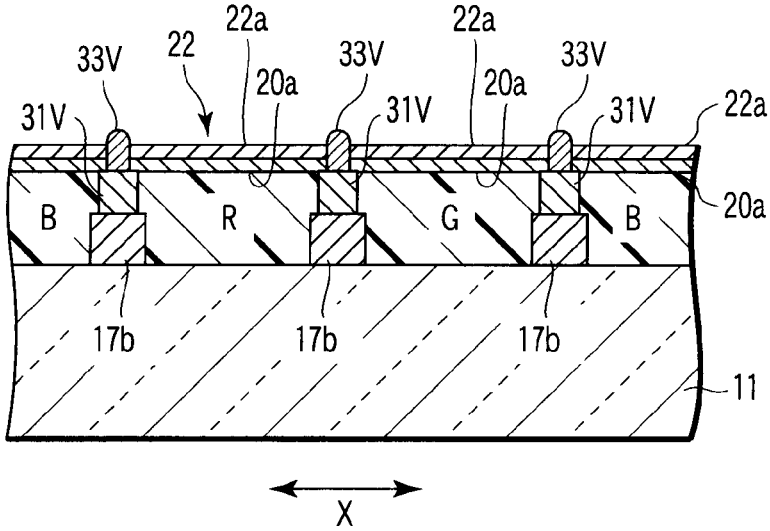
FIG. 5 is a sectional view of the phosphor screen etc., taken along line V-V shown in FIG. 4.
Figure 6:
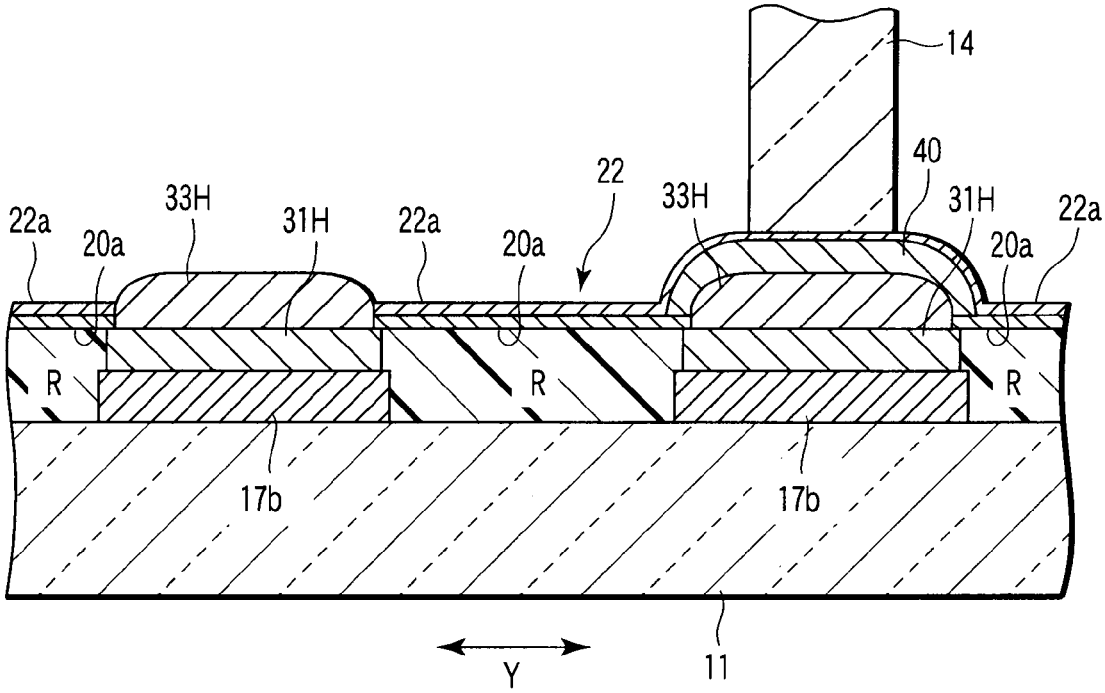
FIG. 6 is a sectional view of the front substrate and spacers, taken along line VI-VI shown in FIG. 4.

As shown in FIGS. 4 to 6, a resistance-adjusting layer 30 is formed on the light-shielding layer 17. The layer 30 has first resistance-adjusting layers 31V and second resistance-adjusting layers 31H, which are provided on the matrix part 17*b* of the light-shielding layer 17. The first resistance-adjusting layers 31V extend in the second direction Y and lie between the phosphor layers that are spaced in the first direction X. The second resistance-adjusting layers 31H extend in the first direction X and lie between the phosphor layers that are spaced in the second direction Y. Since the phosphor layers R, G and B forming any pixel are arranged in the first direction X in the order they are mentioned, the first resistance-adjusting layers 31V are much narrower than the second resistance-adjusting layers 31H. For example, the first resistance-adjusting layers 31V are 40 μm wide, while the second resistance-adjusting layers 31H are 300 μm wide.

A thin-film-dividing layer 32 is formed on the resistance-adjusting layer 30. The layer 32 has a plurality of vertical-line parts 33V and a plurality of horizontal-line parts 33H. The vertical-line parts 33V are formed on the first resistance-adjusting layers 31V of the resistance-adjusting layer 30, respectively. The horizontal-line parts 33H are formed on the second resistance-adjusting layers 31H of the resistance-adjusting layer 30, respectively. The thin-film-dividing layer 32 is made of a binder and particles. The particles are dispersed in such an appropriate density that the layer 32 has projections and depression on and in the surface. The projections and the depressions will divide any thin film that may be thereafter formed on the thin-film-dividing layer 32 by means of vapor deposition or the like. The particles in the thin-film-dividing layer 32 may be made of phosphor, silica or the like. The components of the layer 32 are a little narrower that those of the light-shielding layer 17. For example, the horizontal-line parts 33H are 260 μm wide, and the vertical-line parts 33V are 20 μm wide.

After the thin-film-dividing layer 32 has been formed, a smoothing process is performed, using lacquer or the like, is performed in order to make the metal-back layer 20. The film used in the smoothing process will be burnt out after the metal-back layer 20 has been formed. The smoothing process is well known in the art, employed in manufacturing CRTs or the like. The process is carried out in such conditions that the thin-film-dividing layer 32 is never smoothed.

After the smoothing process, a thin-film forming process such as vapor deposition is performed, forming a metal-back layer 20. The thin-film-dividing layer 32 divides the metal-back layer 20 thus formed, in the first direction X and the second direction Y, into metal-back segments 20*a*. The metal-back segments 20*a* overlap the phosphor layers R, G and B, respectively. In this case, the gap between any adjacent metal-back segments 20*a*, namely the width of the dividing part, is almost the same as the width of the horizontal-line parts 33H of the thin-film-dividing layer 32 and the width of the vertical-line parts 33V thereof. That is, the gap is 20 μm in the first direction X and 260 μm in the second direction Y. In FIG. 4, the metal-back layer 20 is not shown in order not to make the figure complex.

A getter film 22 is formed on the metal-back layer 20. In the FED, the getter film 22 is provided on the phosphor screen in order to maintain a sufficient degree of vacuum for a long time. As in most cases, the getter film 22 can no longer perform its function once it has been exposed to the atmosphere. To avoid this, the getter film 22 is formed by a thin-film process, such as vapor deposition, when the front substrate 11 and the rear substrate 12 are fused together in a vacuum. Even after the metal-back layer 20 has been formed, the thin-film-dividing layer 32 can perform its function of dividing the metal-back layer 20. Therefore, the getter film 22 is divided by two-dimensional dividing in the same pattern as the metal-back layer 20. Getter-film segments 22*a* are thereby formed. The getter film 22 is made of electrically conductive metal as in most cases. In spite of the getter film 22 thus formed, the phosphor screen is never electrically conductive.

Figure 7:
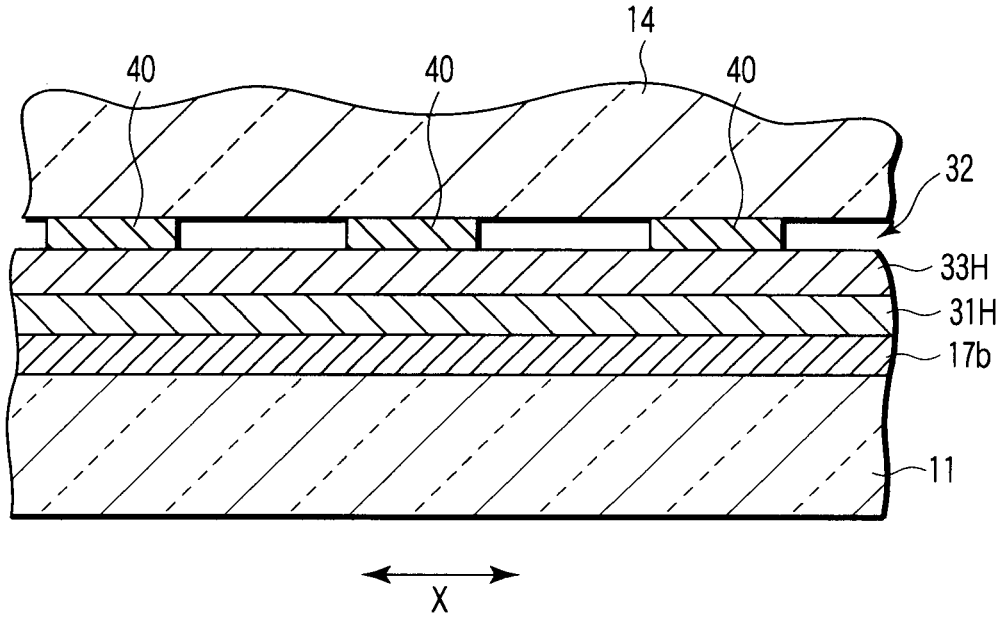
FIG. 7 is a sectional view of the front substrate and spacers, taken along line VII-VII shown in FIG. 4.

As shown in FIGS. 4, 6 and 7, the spacers 14 are arranged, each facing the corresponding horizontal-line part 33H of the thin-film-dividing layer 32. A plurality of spacer-abutting layers 40 are formed on each horizontal-line part 33H. Each spacer-abutting layer 40 has been formed by applying silver paste by means of printing. Since the precision of the printing is limited, each spacer-abutting layer 40 cannot have too small a size. Therefore, the ends of each layer 40, which are spaced in the second direction Y, slightly overlap one metal-back segment 20*a* and four phosphor layers, every two of which are arranged, respectively, on the sides of one horizontal-line part 33H as viewed in the second direction. The spacer-abutting layers 40 are intermittently arranged, spaced apart in the first direction X. Thus, every four metal-back segments 20*a* are locally conductive. The current increase resulting from this can be suppressed to a small value, nevertheless. The spacer-abutting layers 40 are so adjusted in thickness that their upper surfaces closer to the rear substrate 12 than the upper surface of the thin-film-dividing layer 32. Therefore, the spacers 14 about on the spacer-abutting layers 40, without directly contacting the thin-film-dividing layer 32.

To contact the spacers readily and not to be electrically charged, it is desirable that the spacer-abutting layers 40 are electrically conductive. Nonetheless, they can be insulating ones.

It is required that the entire upper surface of each spacer-abutting layer 40 be closer to the rear substrate 12 than the thin-film-dividing layer 32. Even if this requirement is not completely satisfied, for example if the thin-film-dividing layer 32 is closer, in part, to the rear substrate 12 than the upper surface of each spacer-abutting layer 40, the effect can be attained. Thus, this requirement is not one that should be satisfied by any means.

In the embodiment described above, every four metal-back segments 20*a* are connected to one another. Instead, every two metal-back segments 20*a* are connected or more metal-back segments 20*a* may be connected to form a unit, depending on the pixel size and the process performed. Unless the ends of each spacer-abutting layer 40 are connected to adjacent two metal-back segments 20*a*, there will develop a narrow gap. Discharge in this gap makes a problem. However, this problem is not always fatal to the display apparatus. Thus, in most cases, the advantage of this invention can be attained only if the spacer-abutting layers 40 are discretely arranged near the thin-film-dividing layer 32.

As FIG. 2 shows, a common power-supplying line 41 is formed, which extends along the four sides of the front substrate 11. Of the metal-back segments 20*a*, those that are arranged in the second direction Y at the outer peripheral edges of the front substrate 11 are electrically connected to the common power-supplying line 41 by connecting resistors (not shown) that extend in the first direction X. The metal-back segments 20*a* that are arranged in the first direction X at the outer peripheral edges of the front substrate 11 are connected to the common power-supplying line 41 by connecting resistors (not shown) that extend in the second direction Y. The common power-supplying line 41 is connected to an external high-voltage source (not shown). An anode voltage of a desirable value is applied to the metal-back segments 20*a* through the common power-supplying line 41 and the connecting resistors.

The spacers 14 provided between the front substrate 11 and the rear substrate 12 abut the spacer-abutting layers 40, which in turn abut the horizontal-line parts 33H of the thin-film-dividing layer 32. Hence, the thin-film-dividing layer 32 can be more reliably prevented from being damaged or exfoliated than in the case where the spacers 14 directly abut the thin-film-dividing layer 32. Since every four metal-back segments 20*a* are locally connected to one another, the discharge current can be reduced as expected.

FEDs, each having the front substrate 11 and electron-emitting elements of surface-conduction type were made and evaluated in terms of discharge damage. There were some cases where a defect for 1 to 2 bits is developed in the electron sources when discharge occurs near the spacers, because no thin-film-dividing layer 32 was used for the spacer line during the two-dimensional dividing. In the case where the present embodiment was applied, no defects were observed in the electron source, and no problems accompanied the spacer abutment. For comparison, a thin-film-dividing layer 32 was formed at the spacer line as at other positions. This FED had the tendency of frequent discharge. The FED was overhauled for the cause of this tendency. The thin-film-dividing layer for the spacer line was found to have been broken. Thus, it was confirmed the particles generated produced at the breakage of the layer had caused the discharge.

There can be provided an image display apparatus in which spacer-abutting layers are provided near the thin-film-dividing layer that has a small strength, the characteristic of two-dimensional dividing can therefore be preserved even at the spacer line, and the discharge current can thus be reduced in all region, and which can therefore achieve high display performance.

Figure 8:
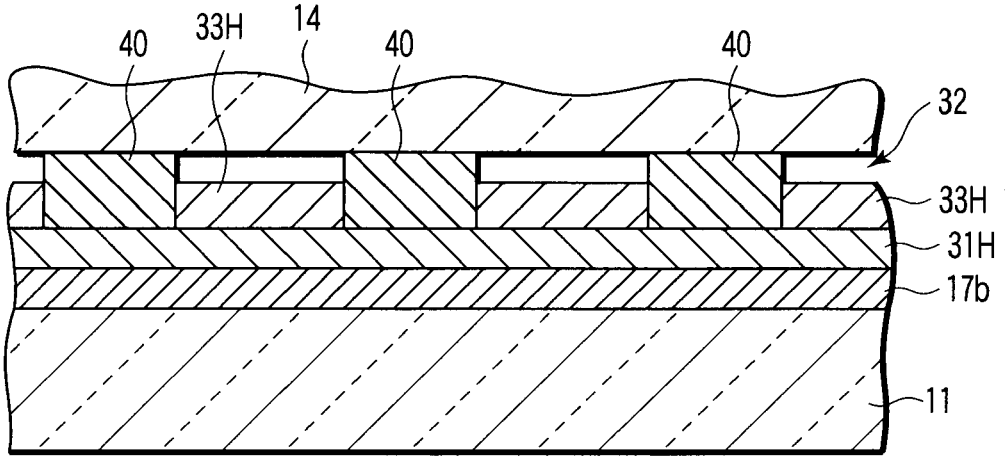
FIG. 8 is a sectional view showing the phosphor screen etc. of a second embodiment of the present invention.

An FED according to a second embodiment of this invention will be described. As shown in FIG. 8, a plurality of spacer-abutting layers 40 are formed on the second resistance-adjusting layers 31H of the resistance-adjusting layer 30, respectively, in the second embodiment. They are arranged at preset intervals in the first direction X. The horizontal-line parts 33H of the thin-film-dividing layer 32 are formed on the second resistance-adjusting layers 31H, each lying between two spacer-abutting layers 40 that are adjacent in the first direction X. Each spacer-abutting layer 40 is thicker than the thin-film-dividing layer 32 and projects from the layer 32 toward the rear substrate 12. The spacers 14 abut the spacer-abutting layers 40, not contacting the spacer-abutting layers 40.

The FED according to the second embodiment is identical to the first embodiment in any other structural respects. The components identical to those of the first embodiment are designated by the same reference numerals and will not be described in detail.

In the second embodiment, each spacer 14 abuts a spacer-abutting layer 40, which in turn abuts a second resistance-adjusting layer 31H. Therefore, no pressure acts on the thin-film-dividing layer 32 through the spacers 14. This can reliably prevent the thin-film-dividing layer 32 from being damaged or exfoliated.

This invention is not limited directly to the embodiment described above, and its components may be embodied in modified forms without departing from the scope or spirit of the invention. Further, various inventions may be made by suitably combining a plurality of components described in connection with the foregoing embodiments. For example, some of the components according to the foregoing embodiments may be omitted. Furthermore, components according to different embodiments may be combined as required.

The various components are not limited, in terms of size and material, to those specified above in junction with the embodiments. Their sizes and materials can be changed, as is needed. In the embodiments described above, the spacer-abutting layers are provided on only those horizontal parts of the thin-film-dividing layer, which faces the spacers. Nonetheless, the spacer-abutting layers may be provided on all horizontal parts. Further, the spacers 14 are not limited to plate-shaped ones. Instead, they may be shaped like pillars in.

What is claimed is:

1. An image display apparatus, comprising:

a front substrate which has a phosphor screen including a plurality of phosphor layers arranged at a specific pitch in a first direction and at another specific pitch in a second direction intersecting at right angles to the first direction and including a light-shielding layer divided metal-back layers laid on the phosphor screen and divided, in the first and second directions divided getter films laid on the metal-back layer and divided, in the first and second directions, and a thin-film dividing layer formed on divided portions of at least one of the divided metal-back layers and the divided getter-films;

a rear substrate which is opposed to the front substrate and on which are arranged a plurality of electron-emitting elements configured to emit electrons toward the phosphor screen;

a plurality of spacers which support the front substrate and the rear substrate against the atmospheric pressure applied to the substrates, and spacer-abutting layers are discretely arranged near the thin-film-dividing layer, at positions where the spacer-abutting layers abut the spacers, wherein ends of each spacer-abutting layer, which are spaced in the second direction, overlap four divided metal-back layers, two of which are positioned at one of the sides of the thin-film-dividing layer, as viewed in the second direction, and the remaining two of which are positioned at the other side of the thin-film-dividing layer.

2. The image display apparatus according to claim 1, wherein the spacer-abutting layers are electrically conductive.

3. The image display apparatus according to claim 1, wherein each of the spacers is shaped like a long plate and extends in the first direction.

4. A image display apparatus, comprising:

a front substrate which has a phosphor screen including a plurality of phosphor layers arranged at a specific pitch in a first direction and at another specific pitch in a second direction intersecting at right angles to the first direction and including a light-shielding layer divided metal-back layers laid on the phosphor screen and divided, in the first and second directions divided getter films laid on the metal-back layer and divided, in the first and second directions, and a thin-film dividing layer formed on divided portions of at least one of the divided metal-back layers and the divided getter-films;

a rear substrate which is opposed to the front substrate and on which are arranged a plurality of electron-emitting elements configured to emit electrons toward the phosphor screen;

a plurality of spacers which support the front substrate and the rear substrate against the atmospheric pressure applied to the substrates, and spacer-abutting layers are discretely arranged near the thin-film-dividing layer, at positions where the spacer-abutting layers abut the spacers, wherein an upper surface of each spacer-abutting layer is closer to the rear substrate than an upper surface of the thin-film dividing layer, wherein ends of each spacer-abutting layer, which are spaced in the second direction, overlap four divided metal-back layers, two of which are positioned at one of the sides of the thin-film-dividing layer, as viewed in the second direction, and the remaining two of which are positioned at the other side of the thin-film-dividing layer.

5. The image display apparatus according to claim 4, wherein the spacer-abutting layers are electrically conductive.

6. The image display apparatus according to claim 4, wherein each of the spacers is shaped like a long plate and extends in the first direction.

* * * * *